US005918905A

United States Patent [19]

Wilen

[11] Patent Number: 5,918,905

[45] Date of Patent: Jul. 6, 1999

[54] TELEVISION PROGRAM GUIDE BOOKLET THAT CAN BE TORN APART TO FORM INDIVIDUAL TELEVISION PROGRAM GUIDE BOOKLETS

[76] Inventor: Richard Wilen, 135 Oval Dr., Islandia, N.Y. 11722

[21] Appl. No.: 08/977,930

[22] Filed: Nov. 24, 1997

Related U.S. Application Data

[63] Continuation of application No. 08/646,728, May 3, 1996, abandoned, which is a continuation of application No. 08/335,193, Nov. 7, 1994, abandoned, which is a continuation of application No. 07/990,017, Dec. 14, 1992, abandoned.

[51] Int. Cl.[6] ..... B42D 1/00

[52] U.S. Cl. ..... 281/16; 281/38; 283/63.1; 462/57

[58] Field of Search ..... 281/16, 15.1, 51, 281/38, 5; 283/63.1; 462/62, 63, 57

[56] References Cited

U.S. PATENT DOCUMENTS

| | | | |
|---|---|---|---|
| 187,221 | 2/1877 | Deusner, Jr. . | |
| 636,350 | 11/1899 | Norrington | 281/15.1 |
| 651,587 | 6/1900 | Wilt | 281/15.1 |
| 773,594 | 11/1904 | Robinson | 281/16 |
| 2,322,647 | 6/1943 | Luce | 712/2 X |
| 3,883,161 | 5/1975 | McGee et al. | 283/50 |
| 3,920,267 | 11/1975 | Lyon, Jr. | 281/16 |
| 4,193,498 | 3/1980 | Rowling | 281/16 X |
| 4,618,166 | 10/1986 | Hsi | 281/15.1 |
| 4,934,740 | 6/1990 | Drake | 281/16 X |

*Primary Examiner*—Willmon Fridie, Jr.
*Attorney, Agent, or Firm*—Stephen E. Feldman

[57] ABSTRACT

A plurality of booklets interconnected end to end in the form of a television guide book-strip, each booklet being printed with television program information arranged horizontally on the pages thereof, the book-strip and booklets having vertical fold lines along its center, the book-strip and booklets having free edges along its lateral sides, the booklets being connected end to end and separable by perforation lines.

One of the booklets can have the television station's or channel's program information arranged on the basis of time, the other of the booklets can have the television program information arranged on the basis of the type of program.

Also the program information printed on the pages of one booklet can be of a different character than the program information printed on the pages of the other booklet. The program information contained in such booklets can be combined with the above described booklets which have program information arranged on the basis of the type of program.

5 Claims, 5 Drawing Sheets

TELEVISION PROGRAM GUIDE BOOKLET THAT CAN BE TORN APART TO FORM INDIVIDUAL TELEVISION PROGRAM GUIDE BOOKLETS

This application is a continuation of application Ser. No. 08/646,728, filed May 3, 1996, now abandoned, which is a continuation of application Ser. No. 08/335,193, filed Nov. 7, 1994, now abandoned, which is a continuation of application Ser. No. 07/990,017 filed Dec. 14, 1992, now abandoned.

FIELD OF THE INVENTION

This invention relates to an article of manufacture and more particularly to a television program guide.

BACKGROUND OF THE INVENTION

Prior to the days of television, radio was a popular home family entertainment. Radio guides, that is the listing of radio presentations to be broadcast over the air during a certain period of time, for example, for a single day of the week, were usually provided on a single page in the back of the local newspaper. In metropolitan areas, for example where daily newspapers were published and sold, the radio program for that particular day was printed in the daily paper, the radio guide was based on time.

In the days of radio and in the days of early TV, program guides were relatively simple. Presentations broadcast were, for the most part, presented live over the air and presentations were not often repeated. Furthermore, the number of broadcast stations, both radio and/or TV were relatively few in any geographical area and both simple, there often being only two daily programs, one program for radio and one for TV.

With relatively few radio stations and/or television broadcast stations or channels receivable in a given geographical area, such as the New York Metropolitan area, for example radio and TV programs, which were set forth on the basis of time, were easily readable and selectable by type.

With the advent of cable television, the number of TV channels receivable over television sets connected to the cable system was greatly increased. The use of satellites for transmitting TV programs further increased the number of channels receivable in any one geographical area. Additionally as the number of TV channels receivable by television sets increased and the technology of TV advanced, recording of complete TV shows or presentations became extremely common. Further, with more TV channels available around the clock, an even increasing number of motion pictures and documentaries and other programs were broadcast over TV. In order to make motion pictures and other types of programs available to more people, these programs were often broadcast or aired several times during the same day and on different days of the week, some times by several different channels. This factor alone make TV programs based on time difficult to publish and difficult to read and select the desired program because of the great number of channels and also because of the repetition of TV presentations involved.

In order to simplify TV program guide and make them more useful and readable, the basis on which TV programs were set forth, that is, the basis of time was changed and TV programs based on titles or types of programming (ie. news/documentary, children, sports) were set forth. This system in the case of movies, produced a long list, in alphabetical order, of TV presentations to be broadcast over a specified period of time, usually a week, with the dates, times and channels over which the particular presentation was to be aired listed after the title of the movie. In some cases this list was discontinuous, starting on one page of the program guide but being continued on several or even tons of pages later on.

It has been suggested that programs, based on presentations on show names be presented to the public as cut-out or tear-out stamps. Each stamp identifies a TV show or presentation on one side and on the other side the schedule of airing is set forth. An organizer may be set up on the basis on the type of program and time, for example, sports for a week or more and pockets in the organizer may be made to receive the stamps according to one's choice and schedule of TV viewing. My U.S. patent entitled Programming Device, U.S. Pat. No. 4,815,225, Registration Date—Mar. 28, 1989 teaches the use of such TV presentations identifying stamps and the use of a TV programmer which is in the form of a calendar, in mirror image, with a transparent flip sheet in the form of a rack or organizer for storing cards or stamps having dates thereto relating to the name of title of a TV presentation on one side of the card or stamp and the schedule of airing and the channel on which the presentation is to be aired on the other side of the card or stamps.

Although the self programming TV programmer of my said copending application is useful and practical, it would be desirable to have the programs prearranged by groups.

An improved programmer which obviates these limitations is taught by my U.S. patent entitled TV Program Organizer, U.S. Pat. No. 4,850,124, Issue Date—Jul. 25, 1989 describes a programmer or organizer that is made from very inexpensive materials, is made very simply and inexpensively and is disposable. The organizer is assembled from a plurality, preferably three (3) sheets, which are of the same width and length. The sheets are folded at a common point. The sheets are glued with stripes of glue or other sheets are assembled thereby forming a plurality of lateral, parallel pockets for holding cards and/or stamps containing data thereon. The material from which the organizer is made may be stock paper, such as 25 lb directory stock and the adhesive may be an inexpensive adhesive or glue. The organizer can be assembled from paper cut into sheets from a roll supply or pre-cut paper and oriented into an offset alignment. The oriented sheets are then folded and secured together to form the organizer. They may be assembled using a sheet paper supply wherein the supply includes a stack of cut paper sheets. Sheets may be separated from the stack one at a time in a group of form sheets and oriented in offset alignment. The sheets may then be folded and secured by strips of adhesive.

Although the improved TV Program Organizer of my co-pending application is useful and practical, it requires that the TV shows or presentations in the type of programs on interest be individually selected from the tear-out stamps and then arranged in the organizer. For example, if the type or area of program of interest is sports, all the tear-out stamps of interest in the sports area must be found, then individually torn from the sheets they are printed on and arranged in the organizer. In many instances, it is more desirable to ahve the programs preselected as to areas of interest.

SUMMARY OF THE INVENTION

The present invention is directed in part to a television guide that is made from very inexpensive materials, is made very simply and inexpensively and is disposable. The guide in its broadcast aspect comprises a plurality of booklets interconnected end to end in the form of a book-strip. Each booklet is printed with program information on the pages thereof and both book-strip have fold lines, said book-strip and booklets being connected end to end and separable by perforation lines. In one of its narrowest aspects, the guide comprises a plurality of booklet comprises a plurality of booklets interconnected end to end in the form of a book-strip. Each booklet is printed with television program information arranged horizontally on the pages thereof and both book-strip and booklets have only vertical fold lines along its center, said book-strip and booklets have only free edges along their lateral sides. The booklets are connected end to end and are separable by perforation lines extending across the middle of said booklet and from one lateral side to the other lateral side. The outside pages of the booklets comprise a cover and each of the booklets have one free edge at either their upper or lower edges. One of the booklets has printed thereon the television program information concerning the television stations or channels arranged on the basis of time. The other booklet has television program information printed thereon on the basis of the type of program (ie. sports, children, news/documentary). Another narrow aspect of the guide provides that the images printed on the pages of one booklet be of a different character (ie. computer and human readable languages, different languages, print and braille) then the images printed on the pages on the other booklet. The book-strip and booklets can be assembled in a conventional manner, the lines of perforations formed before or after each page sheet is printed, These television program guides have a cost of material and cost of assembly which is relatively low and combine to achieve a guide which is both inexpensive and disposable.

More generally the television guide of the present invention comprises a book-strip of booklets that can be mailed as a single item but which can be separated after receipt by the addressee into two separate and/or self contained television guides or booklets. Such separable booklets can also provide identical program information.

DETAILED DESCRIPTION OF THE REFERRED EMBODIMENTS

Figure 1:
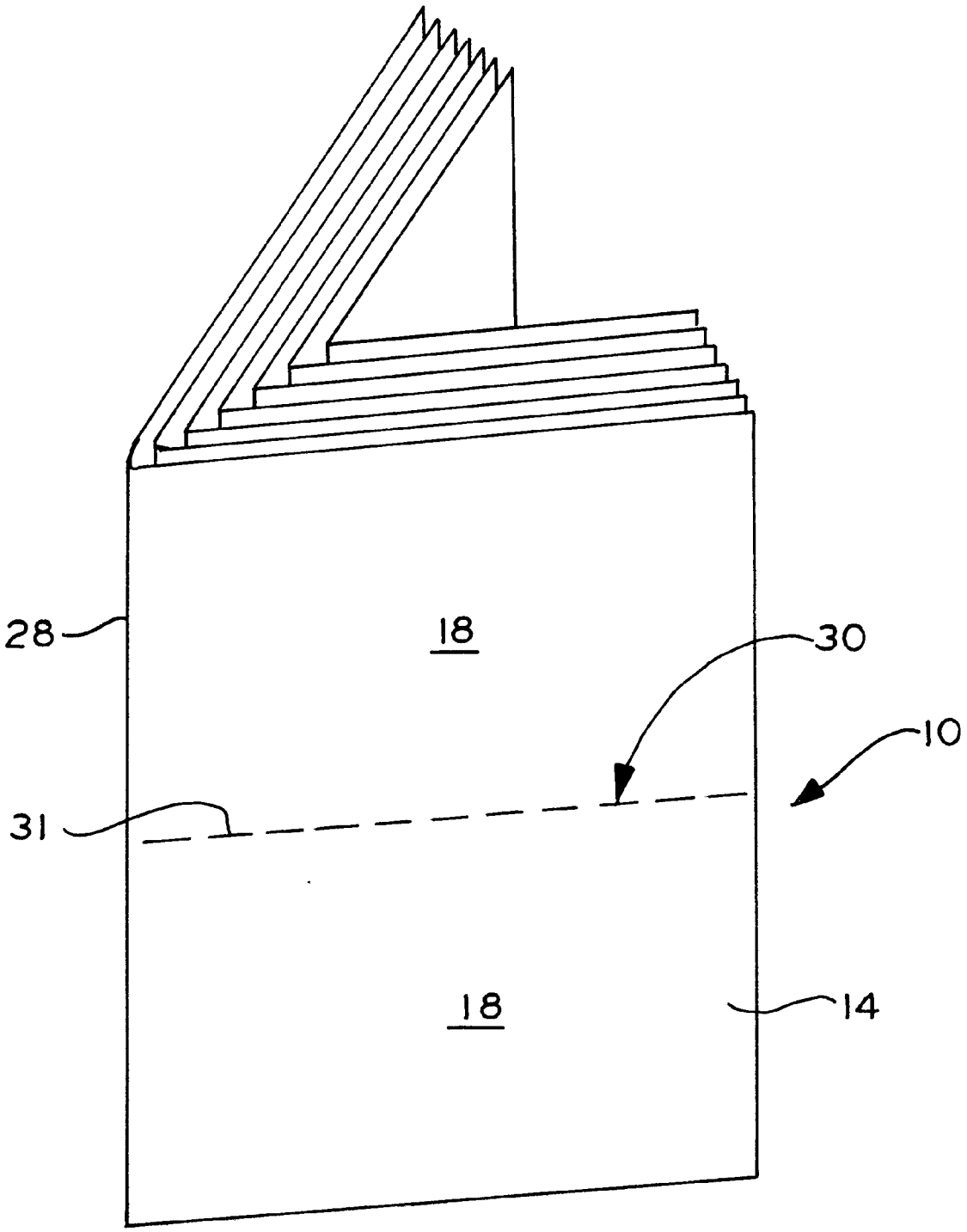
FIG. 1 is a side perspective view of the television book-strip in a partially open position.
Figure 2:
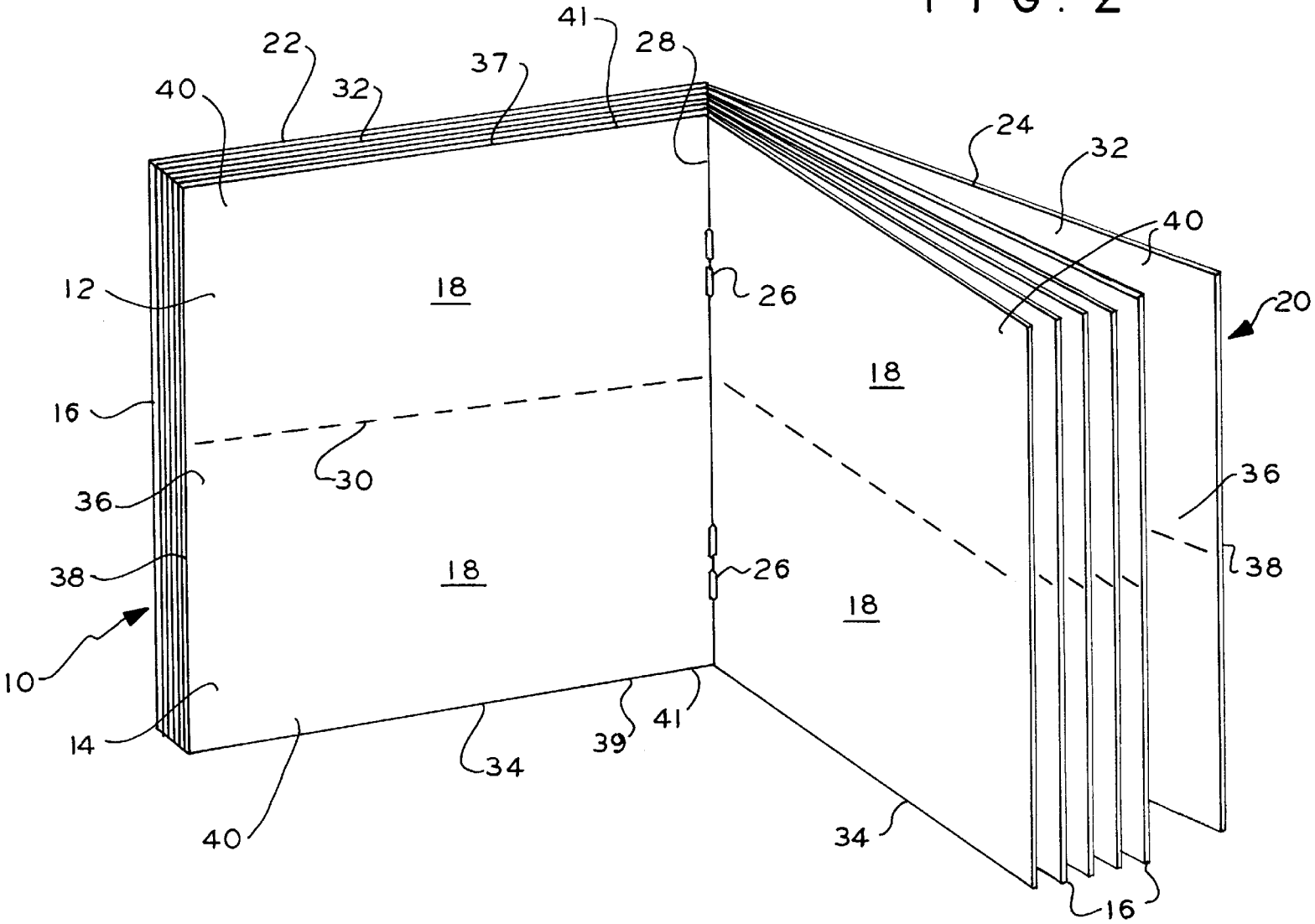
FIG. 2 is detailed perspective view of the television book-strip in an almost fully open position.

Referring to the drawings in detail, wherein like numerals indicate like elements, there is shown in FIGS. 1 and 2 a television guide or book-strip designated generally 10 comprised of two booklets 12 and 14 connected end to end. The booklets 12 and 14 comprise a plurality of sheets 16 having television program information or images 18 printed on both sides thereof, the outside sheet being a cover sheet 20 with front and back cover sheets 22 and 24, respectively. These sheets 16 are secured or bound together by staples 26 at the sheet's center fold line 28. To facilitate the separation of booklets 12 and 14 the sheets 16 are weakened at line 30 by scoring or a line of spaced perforations or the equivalent, hereinafter referred to as "perforation line(s)"31. Each sheet 16 has an upper and lower end 32 and 34, respectively, and all the lateral sides 36 have free ends or edges 38. The upper and lower booklets 12 and 14, respectively, have upper and lower end 37 and 39, respectively. The upper and lower ends 37 and 39, respectively, of upper and lower booklets 12 and 14 respectively, have free ends or edges 41. When the book-strip 10 is separated into individual booklets 12 and 14 the sheets 16 80 split form individual pages 40.

Figure 3:
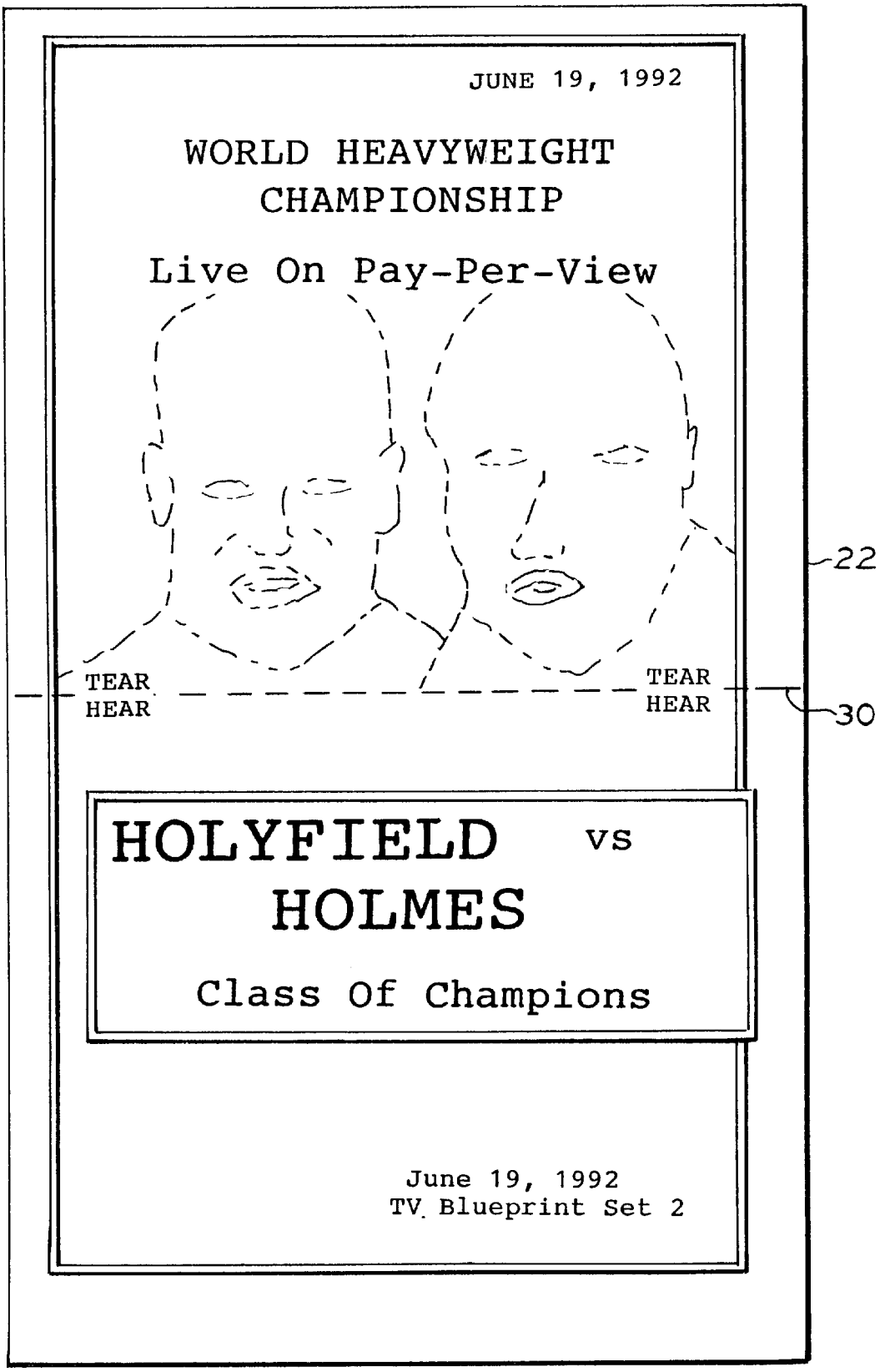
FIG. 3 is a plan view of the front cover of the present invention.
Figure 4:
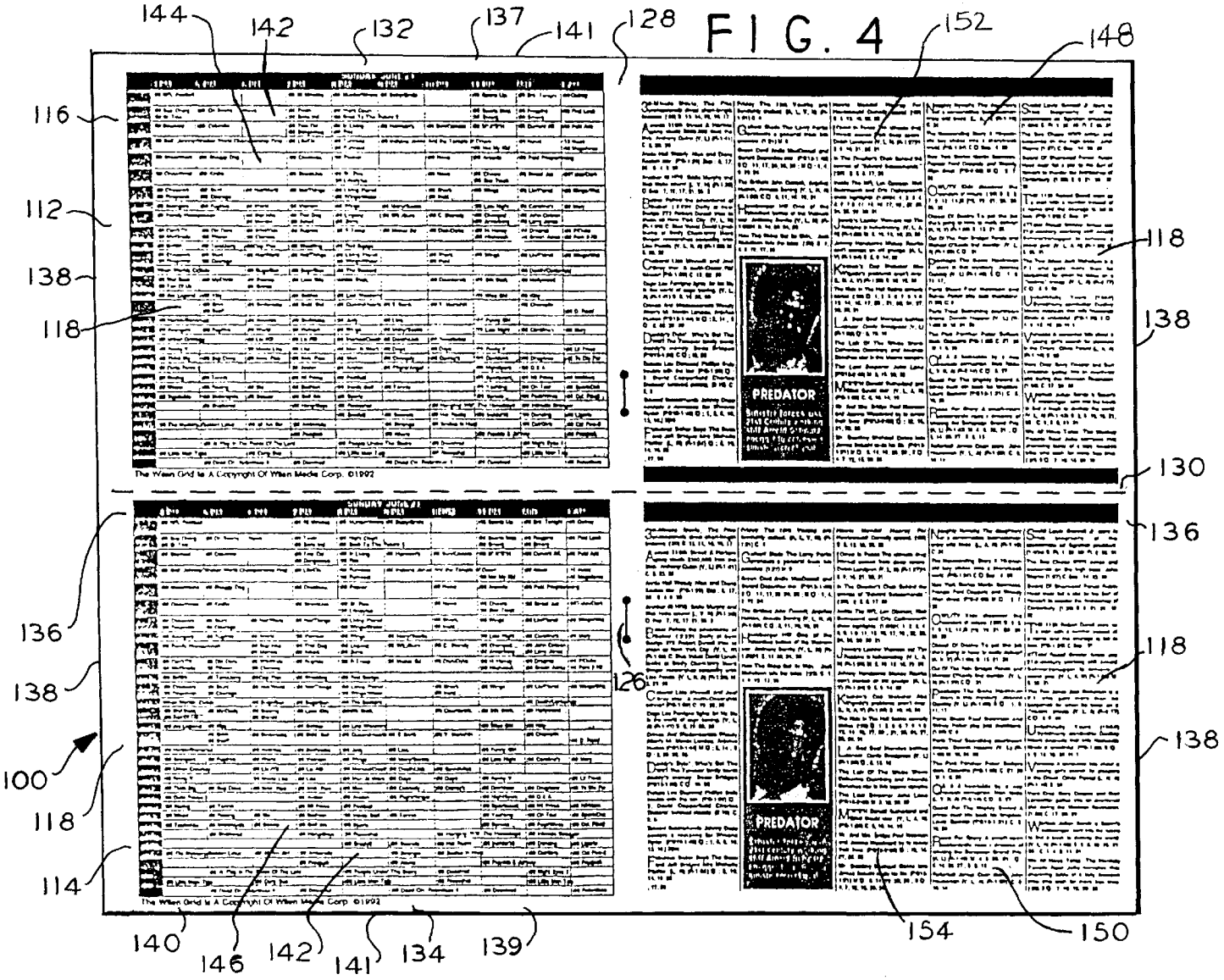
FIG. 4 is a plan view of the television book-strip in a fully open position with program guide information thereon.

In FIGS. 3 and 4 there is shown a book-strip which is in the form of a television guide and which booklets contains identical television program information.

Referring now to FIG. 4 the book-strip 100 comprises two booklets 112 and 114 connected end to end. These booklets 112 and 114 comprise a plurality of sheets 116 (only of which is shown in this view) having television program information 118 printed on both sides thereof. These sheets 116 are secured or bound together by staples 126 at the sheet's center fold line 128. To facilitate the separation of booklets 112 and 114, the sheets 116 are weakened at line 130 by perforation line(s) 131. Each sheet has an upper and lower end 132 and 134, respectively, and all the lateral sides 136 have free ends or edges 138. The upper and lower booklets 112 and 114, respectively have upper and lower ends 137 and 139, respectively. The upper and lower ends 137 and 139, respectively, of upper and lower booklets 112 and 114, respectively, have free ends or edges 141. When the book-strip 100 is separated into individual booklets 112 and 114 the sheets 116 so split form individual pages 140.

In this embodiment each booklet 112 and 114 has the television station's and/or channel's program information 142 disposed or arranged on the basis of time on one side 144 and 146, respectively, of each booklet 112 and 114. The other sides 148 and 150 of each booklet 112 and 114, respectively, have the television program information 152 and 154, respectively, arranged on the basis of the type of program, and in this embodiment the type of program is movies. type of program, and in this embodiment the type of program is movies.

Figure 5:
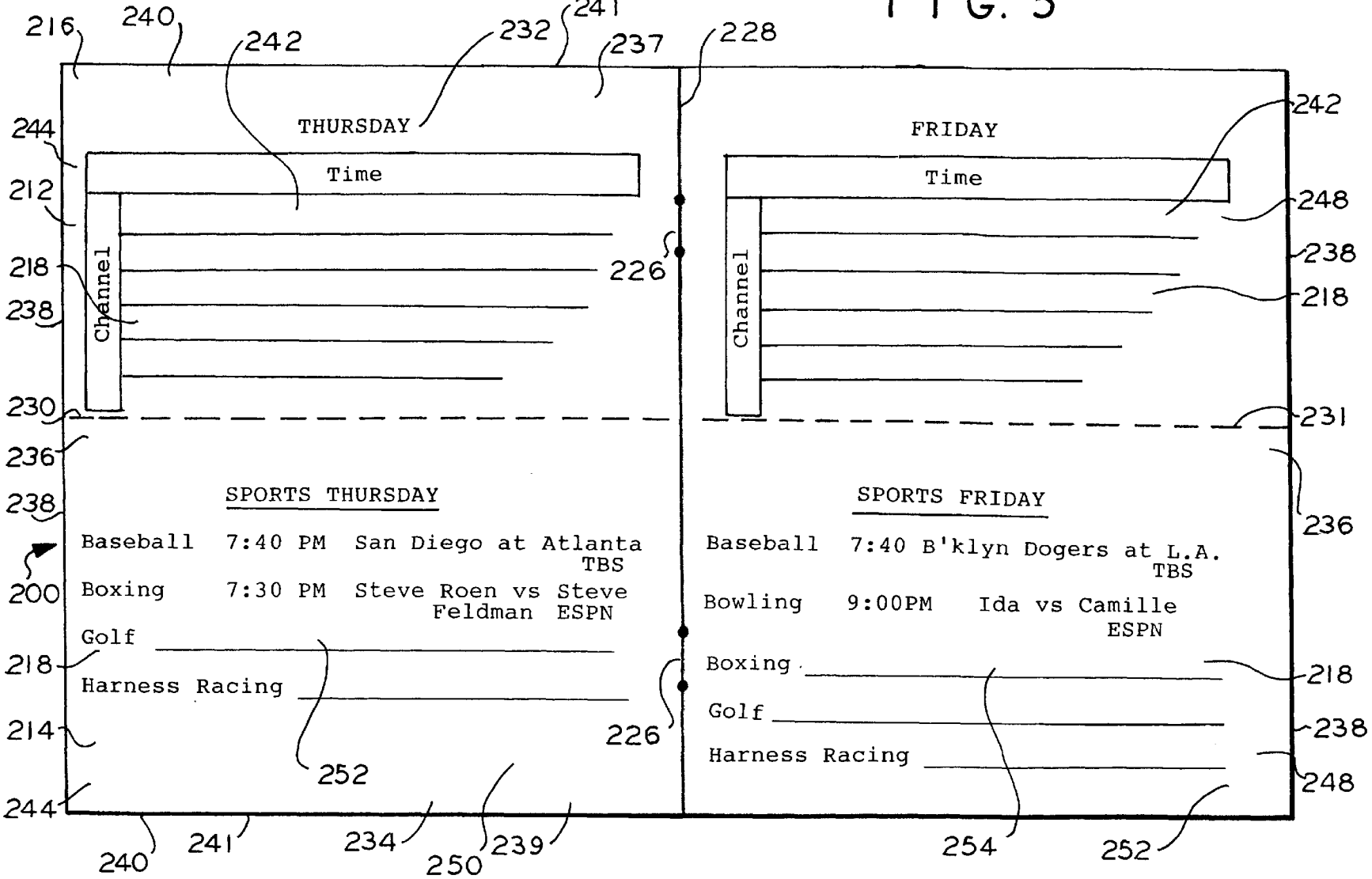
FIG. 5 is a plan view of the television book-strip in a fully open position with program information arranged on the basis of the type of program.

Referring now to FIG. 5 the book-strip 200 comprises two booklets 212 and 214 connected end to end. These booklets 212 and 214 comprise a plurality o sheets 216 (only one of which is shown in this view) having television program information 218 printed on both sides thereof. These sheets are secured by staples 226 at the sheet's center fold line 228. To facilitate the separation of booklets 212 and 214, the sheets 216 are weakened at line 230 by perforation line(s) 230. Each sheet has an upper and lower end 232 and 234, respectively, and all the lateral sides 236 have free edges 238. The upper and lower ends 237 and 239, respectively. The upper and lower ends 237 and 239, respectively, of upper and lower booklets 212 and 214, respectively, have free edges 241. When the book-strip 200 is separated into individual booklets 212 and 214 the sheets 216 so split to form individual pages 240.

In this embodiment booklet 212 has the television station's and/or channels program information 242 disposed on the basis of time on both sides 244 and 248. The other booklet 214 has the television program information 252 and 254 arranged on the basis of the type of program on both sides 246 and 250, and in this embodiment the typed of program is sports. sender is provided with a means of sending or transmitting two booklets which can be easily separated for use and reading by the addressee. From an economic consideration, the book-strip can be considered to be one piece of mail for the purposing of determining the required postage.

After receipt by the recipient, the booklets, as discussed supra, can be read by several individuals at the same time, or one booklet can be read and passed around to another individual while the recipient can keep the other booklet.

The present invention is also adapted to provide information in different time frames, different forms, as well as for recipients of different ages and interests. The previous example of the television program guide illustrated in FIG. 5 and described supra is just one example of a guide wherein the television program information is arranged on the basis of the type and/or time of programs. In addition to sports programs, other types include children programs, teenage children programs, "talk" shows, business programs, health programs, comedy programs, "soaps", news programs, documentaries, nature programs, history programs, evening programs and combined morning-afternoon programs. The foregoing list is not intended to be all inclusive but merely illustrative.

Another category would include those television guides which have program information printed on the pages of one booklet which programs. In addition to sports programs, other types include children programs, teenage children programs, "talk" shows, business programs, health programs, comedy programs, "soaps", news programs, documentaries, nature programs, history programs, evening programs and combined morning-afternoon programs. The foregoing list is not intended to be all inclusive but merely illustrative.

Another category would include those television guides which has program information printed on the pages of one booklet which are of a different character than the program information printed on the pages of other booklets. Such program information can be combined with the preceding described program information arranged on the basis of type and/or time of programs. An example of the same is where one booklet is be adapted for use by a sighted person & the other booklet is in braille & therefore usable by a blind person. Additionally different languages can be used in each booklet. Also one booklet can be computer readable while the other booklet can be in normal human readable form. Similarly one booklet can be in universal code & the other in the English language. The booklets can also contain a bar code for each of the TV shows which bar code can be scanned by a scanner input coupled to a VCR. The invention can also be adapted for using only pictures in one booklet and written description in the other booklet.

More generally the present invention might also be adapted for use of the VCR PLUS+ (a trademark of Gemstar Development Corp.) programming unit in that the Plus Code (a trademark of Gemstar Development Corp.) can be printed in one of the booklets next to the movies, which would be arranged in alphabetically in the booklet; the other booklet could be arranged to provide the usual programming information. Also the present invention. It is particularly adaptable for use in education wherein one booklet contains information useable by a tutor & the other booklet is usable by the student being tutored. Both booklets can also contain unrelated as well as related information as discussed above.

The present invention may be embodied in other specific forms without departing from the spirit or essential attributes thereof and, accordingly, reference should be made to the appended claims, rather than to foregoing specification as indicating the scope of the invention.

What is claimed is:

1. A bookstrip comprising:

(a) a plurality of pages, each of said pages having a vertical center fold line and printed matter on each side of said pages, the printed matter on the facing pages of said bookstrip containing information that is directly correlated;

(b) means to bind said pages together through said center fold line in the form of a book leaving the tops, bottoms and lateral side edges of said pages free; and, (c) means to separate each of said pages horizontally to define an upper booklet and a lower booklet on each of said pages such that said upper booklets and said lower booklets can be removed from one another.

2. The bookstrip of claim 1 wherein said separating means is a perforation line.

3. The bookstrip of claim 1 wherein the printed matter on the upper booklet of a page contains the same kind of data as the data printed on the lower booklet of the same page.

4. The bookstrip of claim 1 wherein the printed matter on the upper booklet of a page contains data that is different from but related to the data printed on the lower booklet of the same page.

5. The bookstrip of claim 1 wherein the printed matter on the upper booklet of a first page contains the same kind of data as the data printed on the upper booklet of its facing page and the printed matter on the lower booklet of said first page is different from but related to the data printed on the upper booklet of said first page but the same as the data printed on the lower booklet of said facing page.

* * * * *